US011088445B2

(12) United States Patent
Su et al.

(10) Patent No.: US 11,088,445 B2
(45) Date of Patent: Aug. 10, 2021

(54) ANTENNA ASSEMBLY WITH COMPACT LAYOUT TRACES

(71) Applicant: Alpha Networks Inc., Hsinchu (TW)

(72) Inventors: De-Chang Su, Hsinchu (TW); Chih-Kai Yang, Hsinchu (TW)

(73) Assignee: ALPHA NETWORKS INC., Hsinchu (TW)

( * ) Notice: Subject to any disclaimer, the term of this patent is extended or adjusted under 35 U.S.C. 154(b) by 406 days.

(21) Appl. No.: 16/238,632

(22) Filed: Jan. 3, 2019

(65) Prior Publication Data

US 2019/0326683 A1 Oct. 24, 2019

(30) Foreign Application Priority Data

Apr. 20, 2018 (TW) ..... 107205217

(51) Int. Cl.

| | |
|---|---|
| ***H01Q 21/00*** | (2006.01) |
| ***H01Q 1/52*** | (2006.01) |
| ***H01Q 5/307*** | (2015.01) |
| ***H01Q 9/04*** | (2006.01) |

(52) U.S. Cl.

CPC ..... *H01Q 1/523* (2013.01); *H01Q 1/521* (2013.01); *H01Q 5/307* (2015.01); *H01Q 9/0421* (2013.01); *H01Q 21/0006* (2013.01)

(58) Field of Classification Search

CPC ..... H01Q 9/0421; H01Q 9/0414

See application file for complete search history.

(56) References Cited

U.S. PATENT DOCUMENTS

| | | | | |
|---|---|---|---|---|
| 6,624,789 | B1 * | 9/2003 | Kangasvieri | H01Q 1/243 343/702 |
| 8,780,002 | B2 * | 7/2014 | Hakansson | H01Q 1/521 343/835 |
| 9,369,187 | B1 * | 6/2016 | Sammeta | H04B 1/40 |
| 9,543,644 | B2 * | 1/2017 | Wu | H01Q 1/523 |
| 9,601,826 | B2 * | 3/2017 | Ai | H01Q 1/243 |
| 10,347,984 | B2 * | 7/2019 | Le Thuc | H01Q 9/0421 |
| 10,790,583 | B2 * | 9/2020 | Lin | H01Q 5/307 |
| 2011/0115687 | A1 * | 5/2011 | Huang | H01Q 1/38 343/843 |

(Continued)

FOREIGN PATENT DOCUMENTS

| | | |
|---|---|---|
| CN | 2919565 Y | 7/2007 |
| CN | 102394384 A | 3/2012 |

(Continued)

*Primary Examiner* — Ab Salam Alkassim, Jr.

(74) *Attorney, Agent, or Firm* — Bacon & Thomas, PLLC

(57) ABSTRACT

An antenna assembly with compact layout traces includes a circuit board and at least one wireless antenna unit, wherein the circuit board is provided with an antenna module, the at least one wireless antenna unit can be located at the same edge or at different edges of the circuit board, each of the at least one wireless antenna unit includes two antennas of the planar inverted-F antenna (PIFA) structure and a neutralization line, and the two antennas are spaced apart from each other and the two ends of the neutralization line are electrically connected to and overlap the two antennas respectively. By arranging antennas of the same working band along the same edge of the circuit board, the corresponding layout traces can be effectively shortened.

16 Claims, 15 Drawing Sheets

(56) References Cited

U.S. PATENT DOCUMENTS

2011/0175792 A1* 7/2011 Yoon ..... H01Q 1/521 343/893
2011/0237207 A1* 9/2011 Bauder ..... H01Q 1/521 455/78
2012/0013519 A1* 1/2012 Hakansson ..... H01Q 1/36 343/835
2012/0075158 A1 3/2012 Kawahata
2012/0212389 A1* 8/2012 Aizawa ..... H01Q 21/28 343/853
2012/0274532 A1* 11/2012 Kurashima ..... H01Q 1/48 343/833
2013/0069842 A1* 3/2013 Lee ..... H01Q 21/28 343/853
2013/0271339 A1* 10/2013 Mikata ..... H01Q 1/50 343/850
2014/0347247 A1* 11/2014 Park ..... H01Q 21/0075 343/893
2015/0042520 A1* 2/2015 Zhao ..... H01Q 9/0421 343/702
2015/0214612 A1* 7/2015 Chen ..... H01Q 1/525 343/841
2016/0190700 A1* 6/2016 Wang ..... H01Q 1/38 343/700 MS
2017/0012345 A1* 1/2017 Zhang ..... H01Q 1/243
2017/0084990 A1* 3/2017 Le Thug ..... H01Q 9/0421
2017/0358861 A1 12/2017 Quinlan et al.
2018/0108984 A1* 4/2018 Wu ..... H01Q 1/521
2018/0151952 A1* 5/2018 Oh ..... H01Q 1/38
2018/0269578 A1* 9/2018 Wu ..... H01Q 5/321
2019/0334254 A1* 10/2019 Wu ..... H01Q 5/307
2019/0372215 A1* 12/2019 Lee ..... H01Q 5/371
2020/0021021 A1* 1/2020 Lin ..... H01Q 5/20

FOREIGN PATENT DOCUMENTS

CN 204067572 U 12/2014
CN 106025520 A 10/2016
CN 205666327 U 10/2016
CN 107453031 A 12/2017
TW 201547105 A 12/2015

* cited by examiner

ANTENNA ASSEMBLY WITH COMPACT LAYOUT TRACES

FIELD OF THE INVENTION

The present invention relates to an antenna assembly and more particularly to one applicable to a MIMO product and with antennas of the same working band arranged along the same edge of a circuit board.

BACKGROUND OF THE INVENTION

Early wireless communication base stations that were constructed in accordance with the IEEE 802.11a/b/g standards only support single-input single-output (SISO) systems, in which only one antenna is used at either end of a wireless communication link to transmit receive wireless signals. If a plurality of people connect their communication devices to such a wireless communication base station at the same time, therefore, the processing efficiency of the base station will be lowered, leading to slow signal transmission.

To boost transmission efficiency, the IEEE 802.11n standard additionally allows for the multi-input multi-output (MIMO) mode, which incorporates the smart antenna design (to help transmit/receive signals in specific directions) and raises the number of antennas that can be used, in order to increase the number of input and output signals, the objective being to substantially enhance the transmission efficiency of wireless signals through multiple inputs and outputs. Moreover, the transmitter end of a MIMO system can transmit numerous wireless signals to overcome the limitations imposed by complicated topography (e.g., walls, floors, complex terrain, or other sources of interference). In the meantime, the receiver of a MIMO system can automatically choose the optimal signal sources from which to compose the original data. Consequently, NUM systems have better transmission performance than their SISO counterparts and are favored by many a user.

Currently, the trend of wireless communication product design is toward compactness and lightweight, so printed antennas have been widely used to maintain the visual appeal of such products. A printed antenna is a planar antenna printed on the circuit board of a product. As the circuit board reduces in size (to help downsize the product), the difficulty of arranging MIMO antennas on the circuit board increases. More specifically, isolation between antennas and the layout directions of radio frequency (RF) signals are important design factors to consider when it is required to arrange antennas within a limited area without causing distortion or loss of high-frequency signals. To increase isolation between antennas, existing printed antennas are generally provided with additional decoupling structures. Referring to FIG. 1, a circuit board M1 is provided with two antennas M11 for the 2-GHz hand and two antennas M12 for the 5-GHz band. Each antenna M11 has a feed end M111, while each antenna M12 has a feed end M121. The antennas M11 and M12 of different frequency bands are shown in FIG. 1 as arranged together with two decoupling structures T1 and T2 to take into account the radiation patterns of the antennas and isolation within each band.

When put to practical use, however, the aforesaid antenna assembly still leaves something to be desired in terms of its overall configuration. First, the decoupling structures T1 and T2 increase the footprint of the entire antenna assembly. Second, the antennas M11 and M12 of different frequency bands (e.g., 2 GHz and 5 GHz) alternate with the decoupling structures T1 and T2 (see FIG. 1) to increase isolation between the antennas, but this arrangement not only lengthens the layout traces from the 2-GHz antenna chip M21 to the antennas M11 and from the 5-GHz antenna chip M22 to the antennas M12, but also requires certain wires to cross each other (or intersect). As is well known in the art, the longer the layout traces of RF signals are, and the more frequently the wires cross one another, the more the signals tend to attenuate, and the greater the RF loss in each band will be, resulting in lower transmission quality.

According to the above, it has been an important issue in the antenna industry to design a novel antenna assembly that allows both layout traces and wire crossover to be effectively reduced.

BRIEF SUMMARY OF THE INVENTION

In view of the imperfection of existing MIMO antenna assemblies, the inventor f the present invention conducted extensive research and repeated experiment and finally succeeded in developing an antenna assembly with compact layout traces to solve the aforesaid problems effectively.

One objective of the present invention is to provide an antenna assembly that has compact layout traces. The antenna assembly is applicable to a MIMO system-based product and at least includes a circuit board, at least one low-frequency antenna unit, and at least one high-frequency antenna unit. The circuit board is provided with a low-frequency module and a high-frequency module. The low-frequency antenna unit is located at one edge of the circuit board, is electrically connected to the low-frequency module, and is composed of a first low-frequency antenna, a second low-frequency antenna, and a low-frequency neutralization line. The first low-frequency antenna and the second low-frequency antenna are spaced apart from each other and are arranged on one side (hereinafter referred to as the first side) of the circuit board. The low-frequency neutralization line is arranged on the opposite side (hereinafter referred to as the second side) of the circuit board and has two ends that are electrically connected to the first low-frequency antenna and the second low-frequency antenna respectively. The high-frequency antenna unit is located at the same edge of the circuit board as the low-frequency antenna unit or at a different edge, is electrically connected to the high-frequency module, and is composed of a first high-frequency antenna, a second high-frequency antenna, and a high-frequency neutralization line. The first high-frequency antenna and the second high-frequency antenna are spaced apart from each other and are arranged on the first side of the circuit board. The high-frequency neutralization line is arranged on the second side of the circuit board and has two ends that are electrically connected to the first high-frequency antenna and the second high-frequency antenna respectively. Now that the two antennas of each working band are close to each other, the corresponding layout traces can be effectively shortened.

Another objective of the present invention is to provide an antenna assembly that has compact layout traces and at least includes a circuit board and at least one wireless antenna unit. The circuit board is provided with an antenna module. The wireless antenna unit is located at one edge of the circuit board, is electrically connected to the antenna module, and is composed of a first antenna, a second antenna, and a neutralization line. The first antenna and the second antenna are of the planar inverted-F antenna (PIFA) structure and are spaced apart from each other. The two ends of the neutralization line correspond respectively to the first antenna and the second antenna in an overlapping manner and are electrically connected to the first antenna and the second antenna respectively.

BRIEF DESCRIPTION OF THE SEVERAL VIEWS OF THE DRAWINGS

The objectives and technical features of the present invention and the intended effects of those technical features can be better understood by referring to the following detailed description in conjunction with the accompanying drawings, in which.

DETAILED DESCRIPTION OF THE INVENTION

Figure 1:
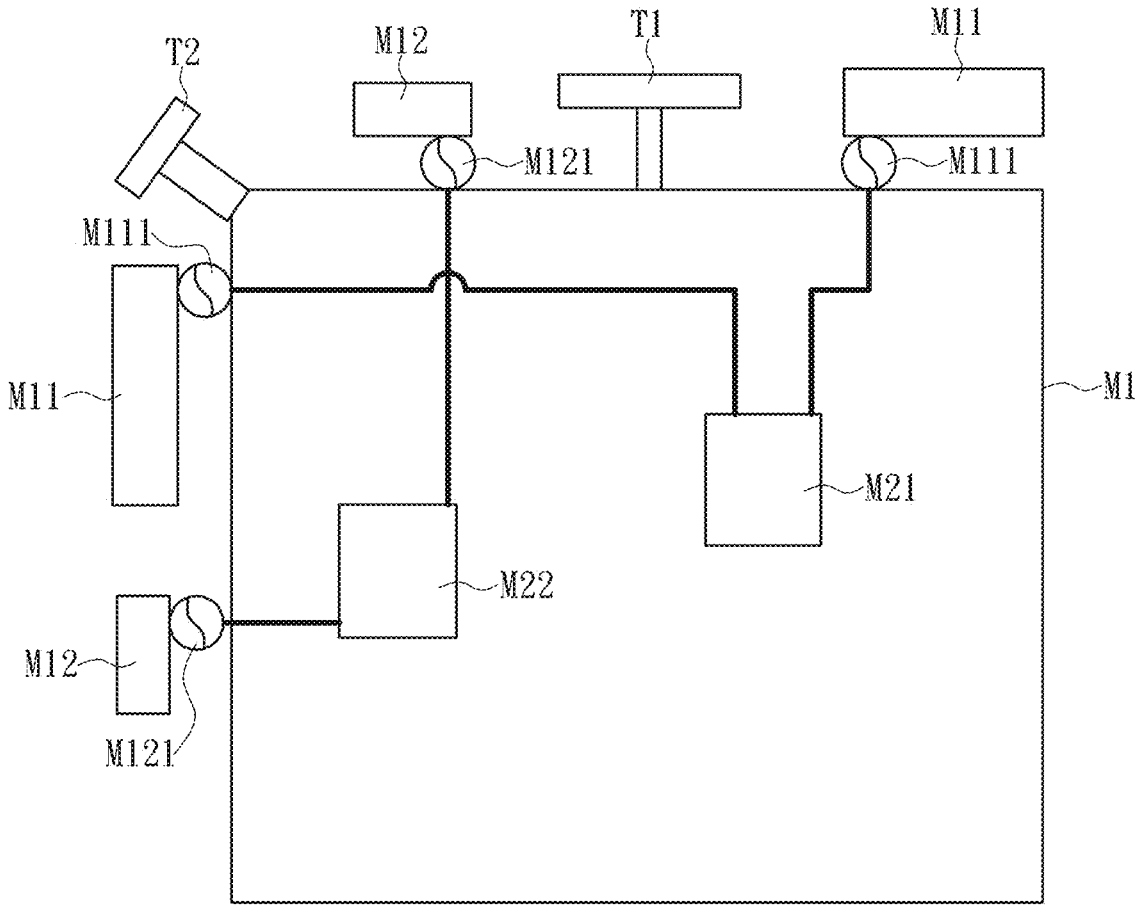
FIG. 1(Prior Art)
FIG. 1 schematically shows a conventional antenna assembly with decoupling structures.
Figure 2:
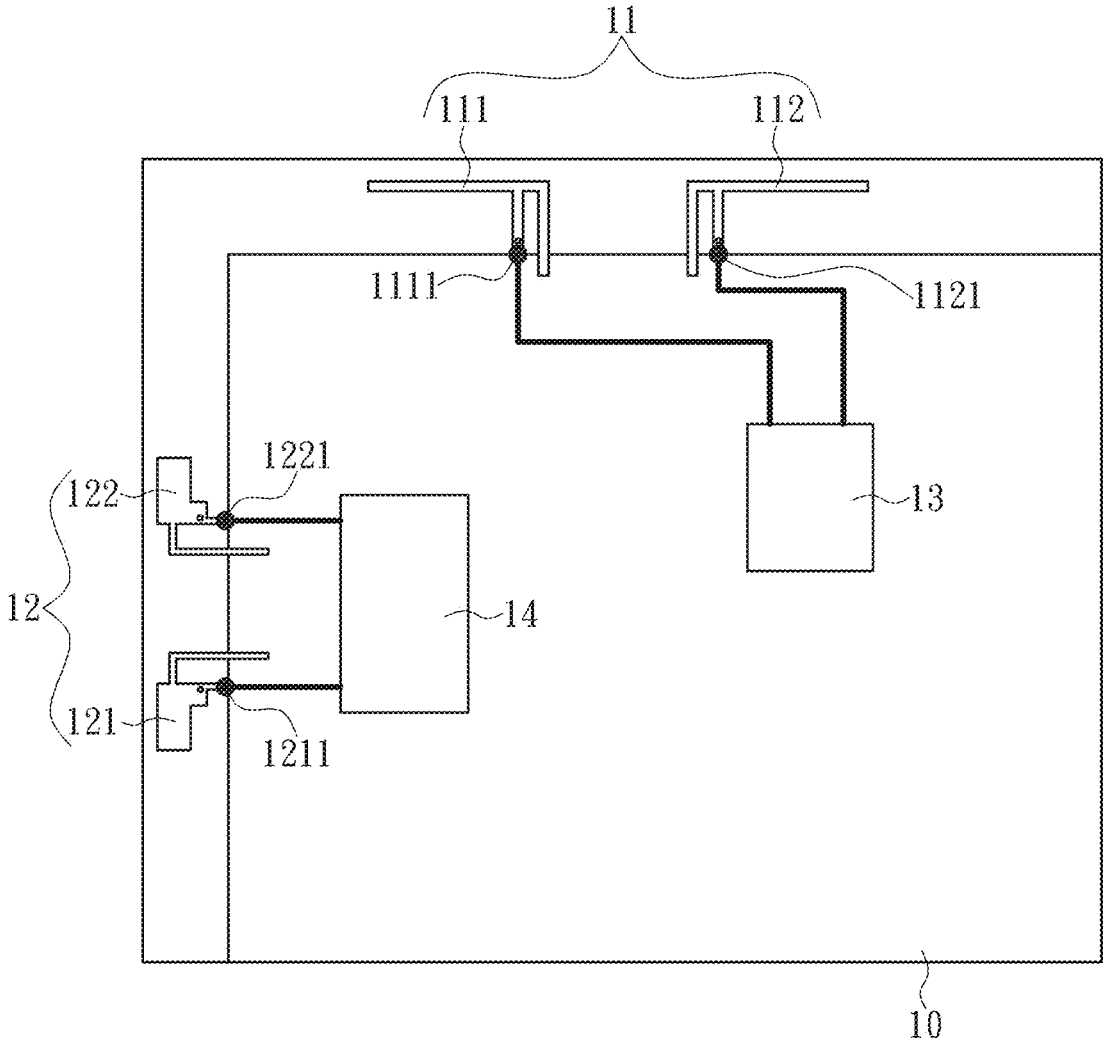
FIG. 2 schematically shows the antenna assembly according to an embodiment of the present invention.
Figure 3:
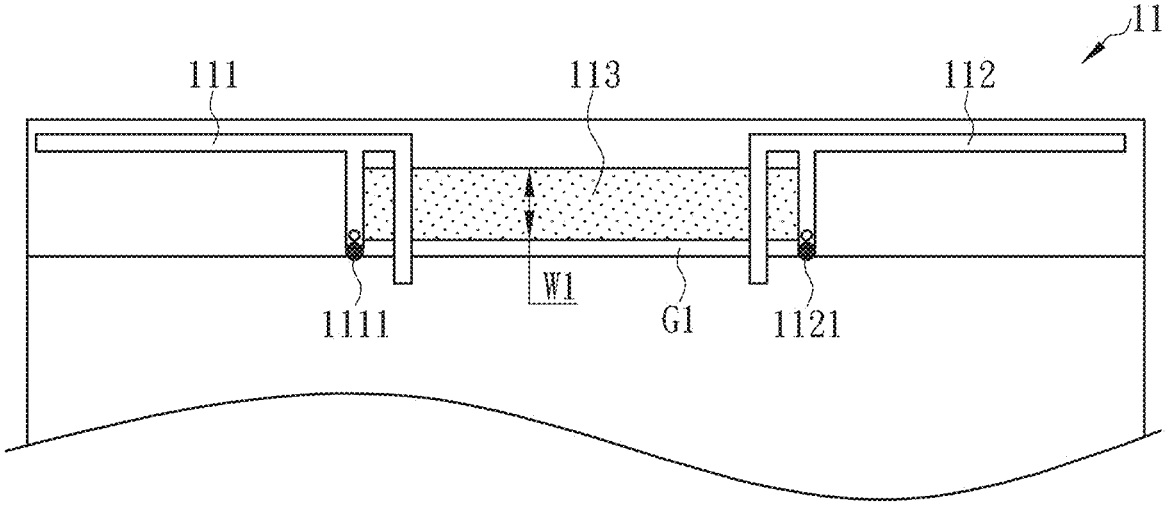
FIG. 3 schematically shows the low-frequency antenna unit of the antenna assembly in FIG. 2.

The present invention provides an antenna assembly that has compact layout traces and that is configured for use in a MIMO system-based product. In one embodiment as shown in FIG. 2 and FIG. 3, the antenna assembly is a 2×2 MIMO antenna assembly by way of example and includes a circuit board 10, at least one low-frequency antenna unit 11, and at least one high-frequency antenna unit 12. The circuit board 10 is provided with a low-frequency module 13 (e.g., a 2 GHz~2.5 GHz antenna chip) and a high-frequency module 14 (e.g., a 5 GHz~5.85 GHz antenna chip). The low-frequency antenna unit 11 is located at one edge of the circuit board 10 and is electrically connected to the low-frequency module 13 in order to operate in the 2 GHz~2.5 GHz frequency band. The high-frequency antenna unit 12 is located at another edge of the circuit board 10 and is electrically connected to the high-frequency module 14 in order to operate in the 5 GHz~5.85 GHz frequency band.

With continued reference to FIG. 2 and. FIG. 3, the low-frequency antenna unit 11 is composed at least of a first low-frequency antenna 111, a second low-frequency antenna 112, and a low-frequency neutralization line 113. The first low-frequency antenna 111 and the second low-frequency antenna 112 are spaced apart from each other and are arranged on one side (hereinafter referred to as the first side) of the circuit board 10. In this embodiment, the low-frequency antennas 111 and 112 are of the PIFA structure, with their respective grounding ends connected to the grounding surface of the circuit board 10, and their respective feed ends 1111 and 1121 electrically and separately connected to the low-frequency module 13. The low-frequency neutralization line 113 is arranged on the opposite side (hereinafter referred to as the second side) of the circuit board 10. The two ends of the low-frequency neutralization line 113 correspond respectively to the first low-frequency antenna 111 and the second low-frequency antenna 112 in such a way that the two ends of the low-frequency neutralization line 113 overlap the two low-frequency antennas 111 and 112 respectively, as shown in FIG. 3. Also, the two ends of the low-frequency neutralization line 113 are electrically connected to the first low-frequency antenna 111 and the second low-frequency antenna 112 respectively. For example, the two ends of the low-frequency neutralization line 113 are brought into contact with the two low-frequency antennas 111 and 112 respectively, thereby guiding one of the first low-frequency antenna 111 and the second low-frequency antenna 112 to couple electric current to the grounding surface and hence interfere less with the other of the first low-frequency antenna 111 and the second low-frequency antenna 112. As the low-frequency neutralization line 113 is connected between the low-frequency antennas 111 and 112 in an overlapping manner to isolate the low-frequency antennas 111 and 112 from each other, the low-frequency antennas 111 and 112 are closer to each other than if a conventional decoupling structure is used therebetween. Moreover, the low-frequency neutralization line 113 lies within a region corresponding to the low-frequency antennas 111 and 112 and therefore occupies less area of the circuit board 10 than if arranged otherwise. It should be pointed out that the low-frequency neutralization line 113 is not on the same surface as the low-frequency antennas 111 and 112 and consequently not shown in FIG. 2. When the circuit board 10 is a single-layer plate structure, the low-frequency antennas 111 and 112 and the low-frequency neutralization line 113 are located on the top and bottom sides of the circuit board 10 respectively, or vice versa. When the circuit board 10 is a multilayer plate structure instead, the low-frequency antennas 111 and 112 and the low-frequency neutralization line 113 are located in/on different layers of the circuit board 10 respectively. That is to say, the low-frequency antenna unit 11 may vary in configuration, provided that the "low-frequency antennas 111 and 112" and the "low-frequency neutralization line 113" do not lie completely on the same surface.

Figure 4:
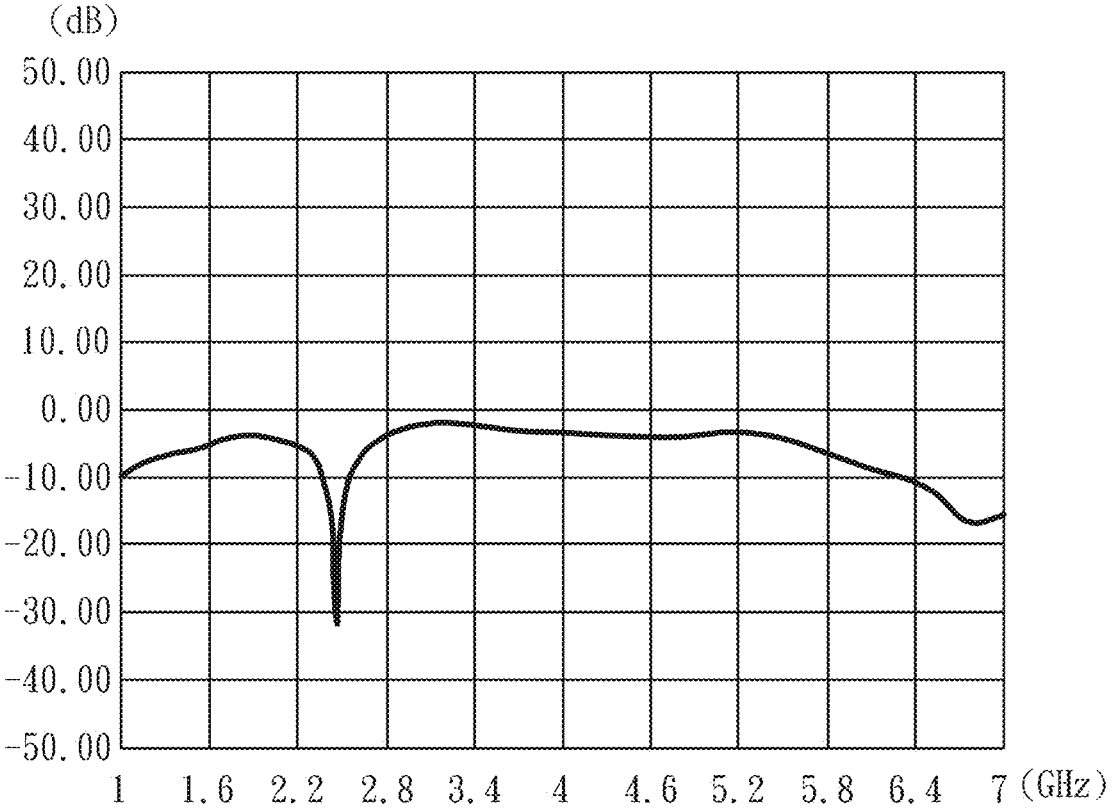
FIG. 4 is a plot showing test results of the low-frequency antenna unit in FIG. 3.
Figure 5A:
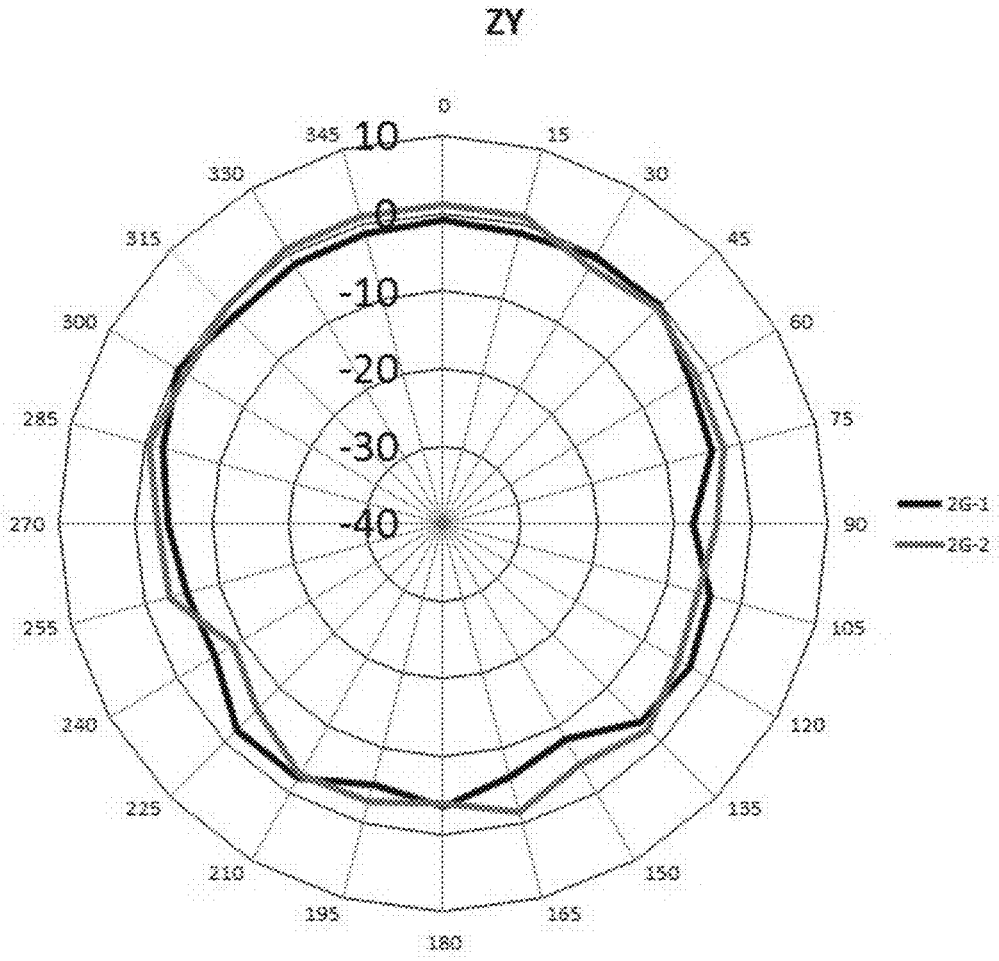
FIG. 5A shows Z-Y plane radiation patterns of the low-frequency antenna unit in FIG. 3.
Figure 5B:
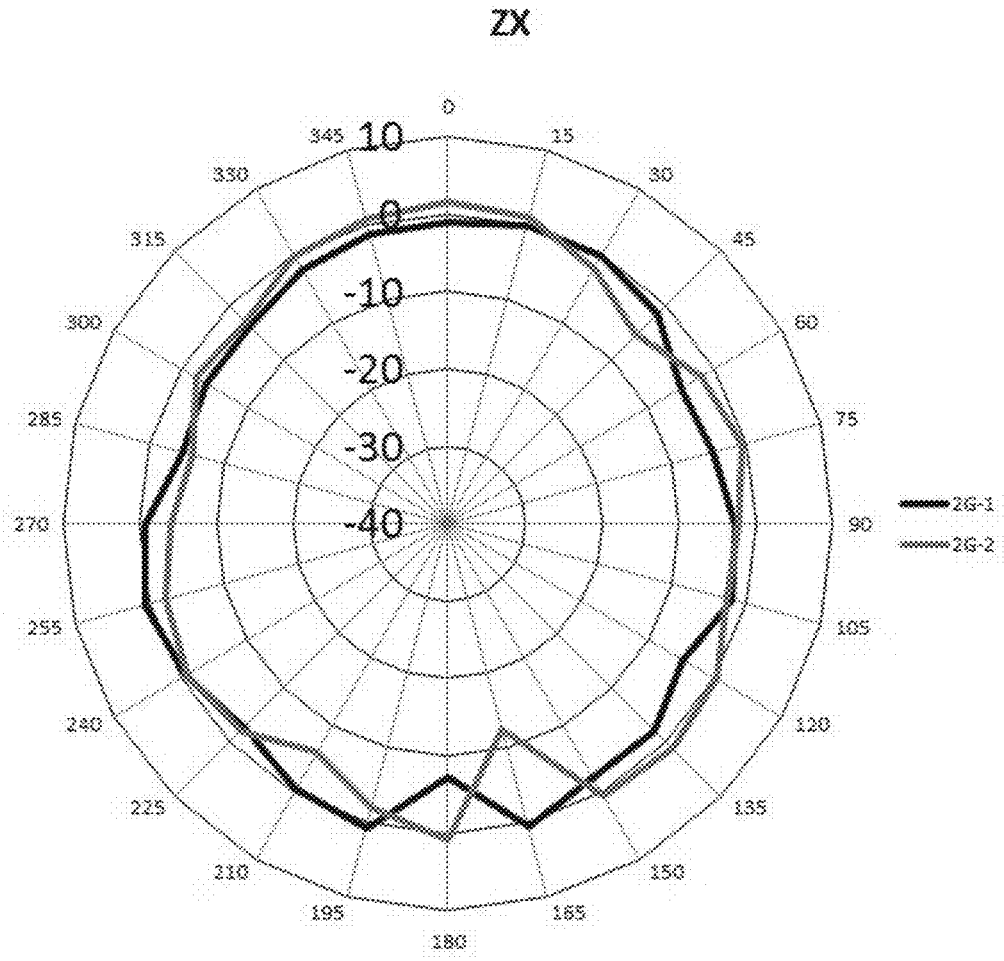
FIG. 5B shows X-Z plane radiation patterns of the low-frequency antenna unit in FIG. 3.
Figure 5C:
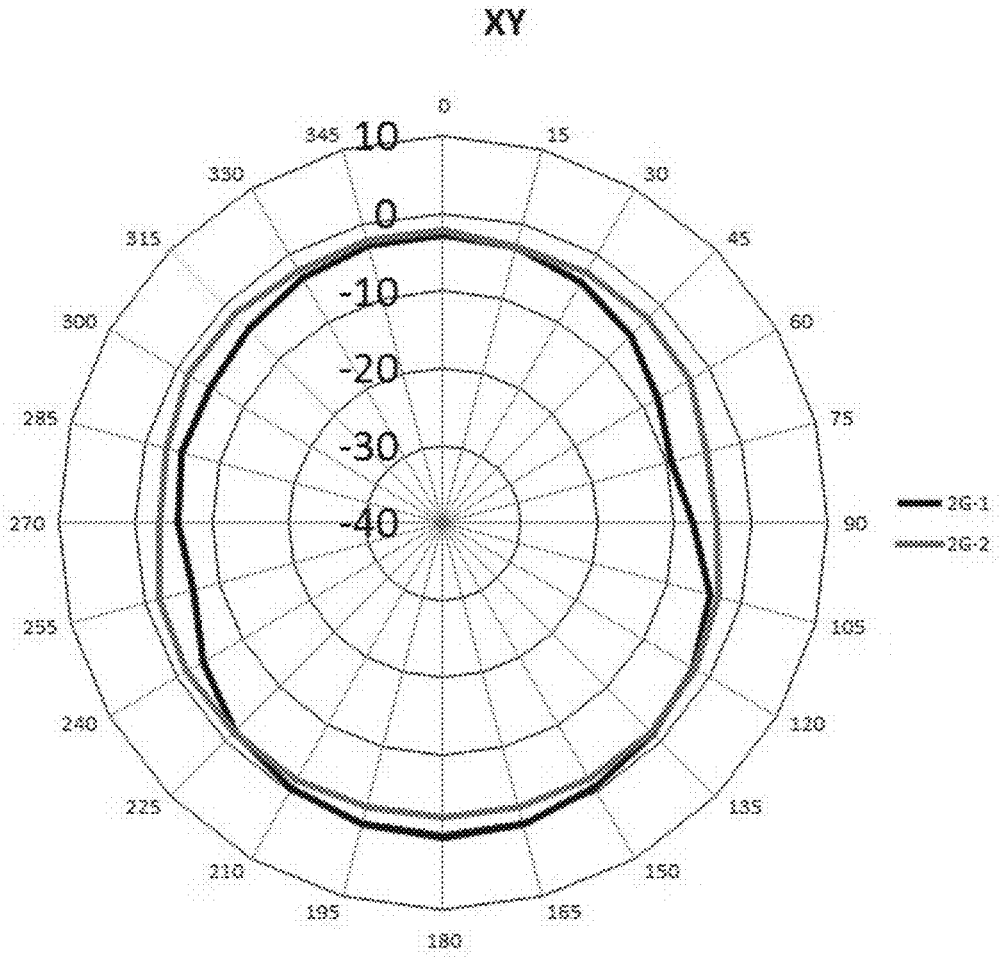
FIG. 5C shows X-Y plane radiation patterns of the low-frequency antenna unit in FIG. 3.
Figure 6A:
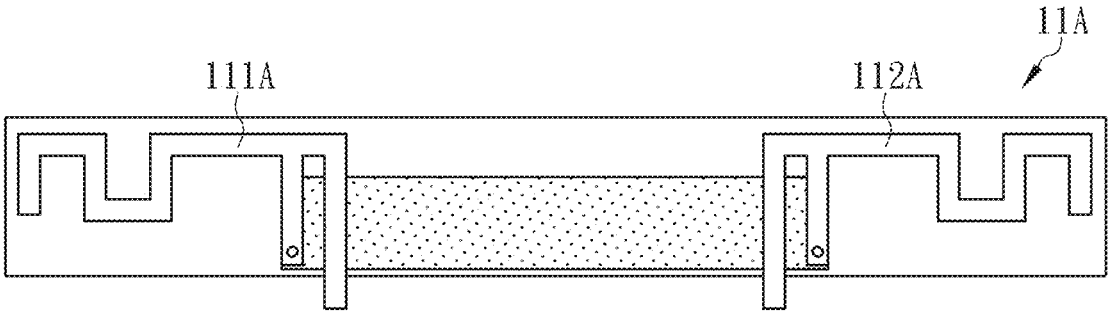
FIG. 6A schematically shows a low-frequency antenna unit of the present invention that has winding antennas.
Figure 6B:
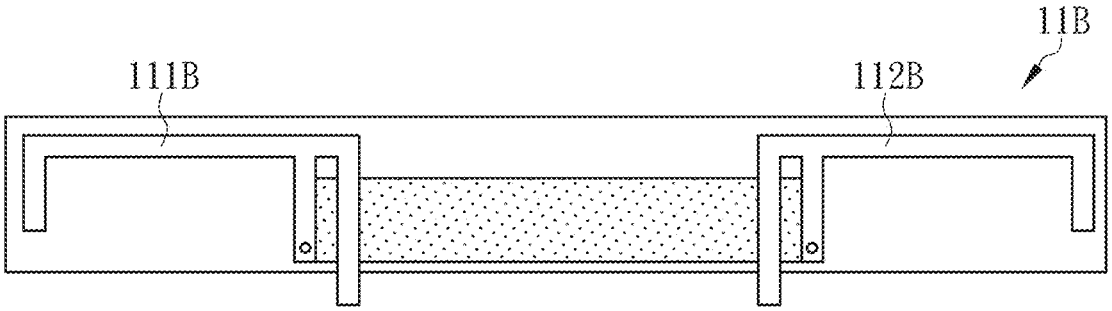
FIG. 6B schematically shows a low-frequency antenna unit of the present invention that has bent antennas.
Figure 6C:
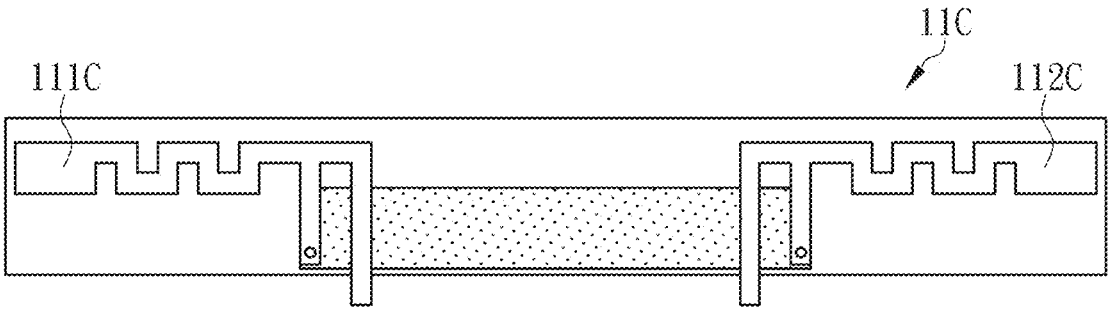
FIG. 6C schematically shows a low-frequency antenna unit of the present invention that has winding antennas with a rectangular region.

The applicant tested the low-frequency antenna unit 11 shown in FIG. 2 and FIG. 3, and the test results are plotted in FIG. 4, in which it can be clearly seen that the low-frequency antennas 111 and 112 have an isolation of −33 dB when the low-frequency antenna unit 11 operates in the 2.46 GHz, and an isolation of −14 dB when the low-frequency antenna unit 11 operates in the 2.4 GHz band (2.415 GHz~2.485 GHz). In terms of radiation patterns, referring to FIG. 5A to FIG. 5C, the low-frequency antenna unit 11 produces omnidirectional in the Z-Y plane (see FIG. 5A), complementary in the X-Z plane (see FIG. 5B) and X-Y plane (see FIG. 5C), wherein the complementarity of radiation patterns is demonstrated, for example, by the fact that recesses of the X-Z plane radiation pattern of the first low-frequency antenna 111 are covered and compensated by the X-Z plane radiation pattern of the second low-frequency antenna 112. In other embodiments of the present invention, the first low-frequency antenna and the second low-frequency antenna may be adjusted in configuration to meet product requirements, as shown by the low-frequency antenna units 11A~11C in FIG. 6A to FIG. 6C. Each of the first low-frequency antennas 111A~111C may have a "winding configuration" (i.e., with a plurality of bends), a "bent configuration" (i.e., with a single bend), or a "winding configuration with a rectangular region", and so may each of the second low-frequency antennas 112A~112C.

Figure 7:
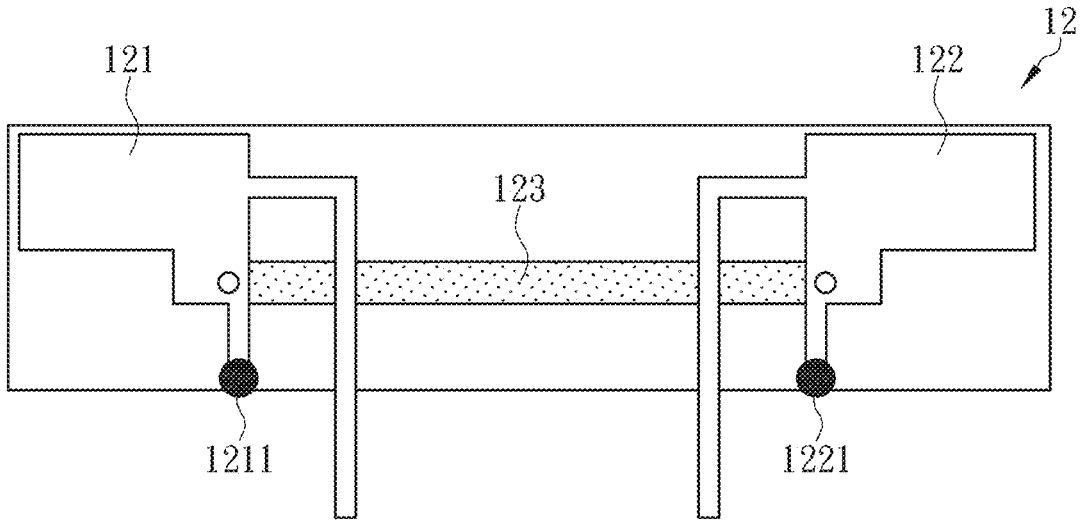
FIG. 7 schematically shows the high-frequency antenna unit of the antenna assembly in FIG. 2.

Referring to FIG. 2 and FIG. 7, the high-frequency antenna unit 12 is composed at least of a first high-frequency antenna 121, a second high-frequency antenna 122, and a high-frequency neutralization line 123. The first high-frequency antenna 121 and the second high-frequency antenna 122 are spaced apart from each other and are arranged on the first side of the circuit board 10 (i.e., on the same side as the low-frequency antennas 111 and 112). In this embodiment, the high-frequency antennas 121 and 122 are of the PIFA structure, with their respective grounding ends connected to the grounding surface of the circuit board 10, and their respective feed ends 1211 and 1221 electrically and separately connected to the high-frequency module 14. The high-frequency neutralization line 123 is arranged on the second side of the circuit board 10 (i.e., on the same side as the low-frequency neutralization line 113). The two ends of the high-frequency neutralization line 123 correspond respectively to the first high-frequency antenna 121 and the second high-frequency antenna 122 in such a way that the two ends of the high-frequency neutralization line 123 overlap the two high-frequency antennas 121 and 122 respectively, as shown in FIG. 7. Also, the two ends of the high-frequency neutralization line 123 are electrically connected to the first high-frequency antenna 121 and the second high-frequency antenna 122 respectively and are adjacent to the feed ends 1211 and 1221 of the first and the second high-frequency antennas 121 and 122 respectively; thus, the high-frequency neutralization line 123 isolates the high-frequency antennas 121 and 122 from each other. Moreover, with the high-frequency neutralization line 123 overlapping the first high-frequency antenna 121 and the second high-frequency antenna 122, the high-frequency antennas 121 and 122 are closer to each other than if a conventional decoupling structure is used therebetween. In addition, the high-frequency neutralization line 123 lies within a region corresponding to the high-frequency antennas 121 and 122 and therefore occupies less area of the circuit board 10 than if arranged otherwise.

Figure 8:
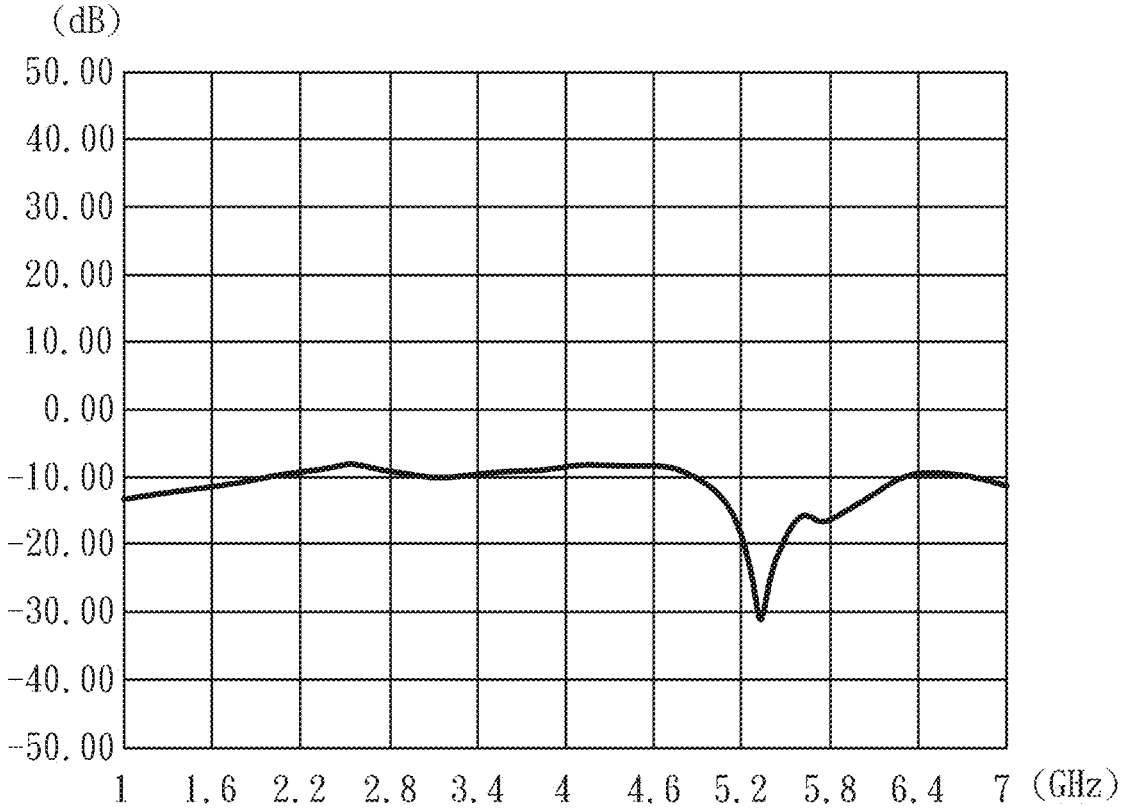
FIG. 8 is a plot showing test results of the high-frequency antenna unit in FIG. 7.
Figure 9A:
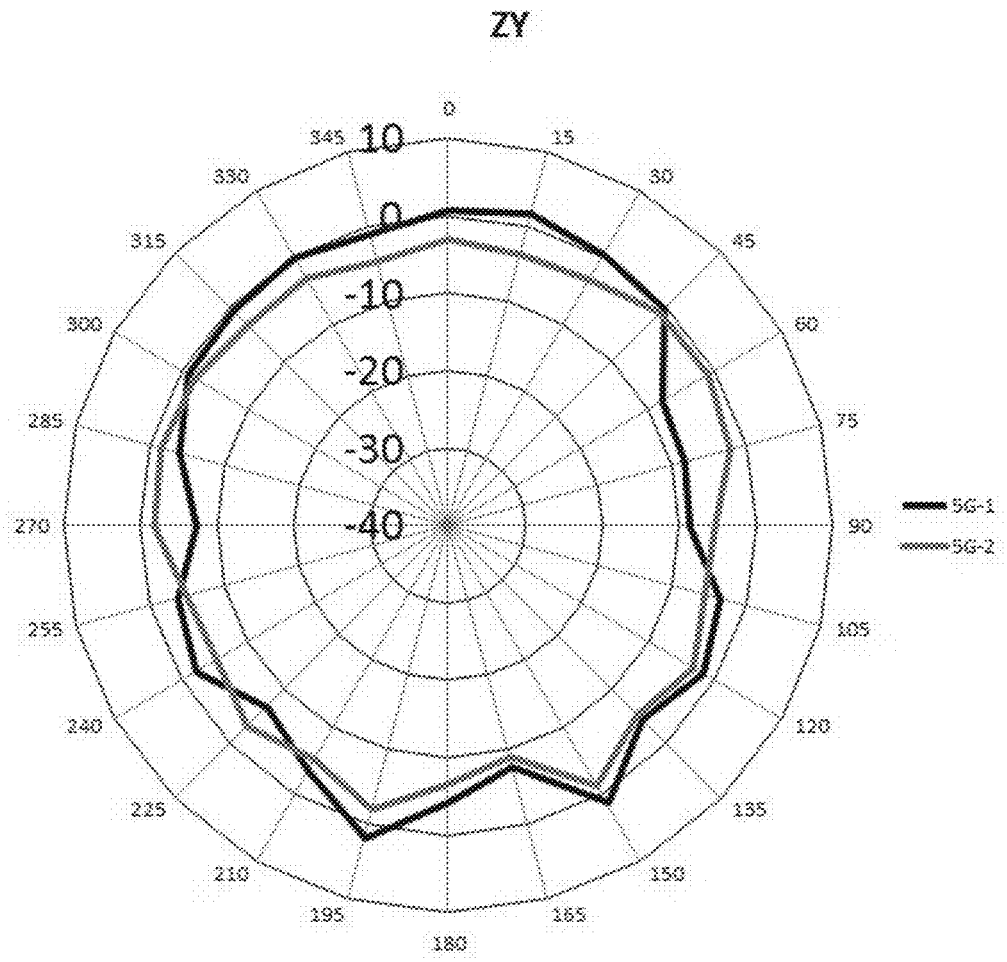
FIG. 9A shows Z-Y plane radiation patterns of the high-frequency antenna unit in FIG. 7.
Figure 9B:
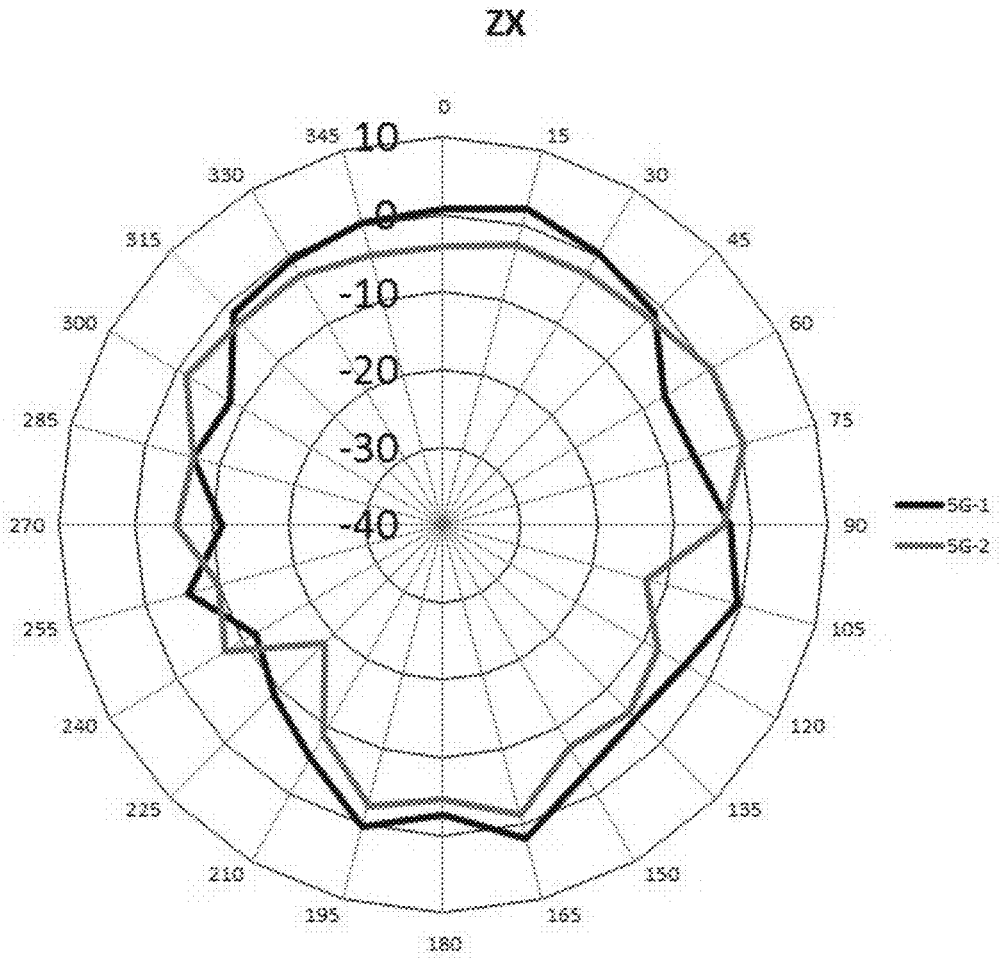
FIG. 9B shows X-Z plane radiation patterns of the high-frequency antenna unit in FIG. 7.
Figure 9C:
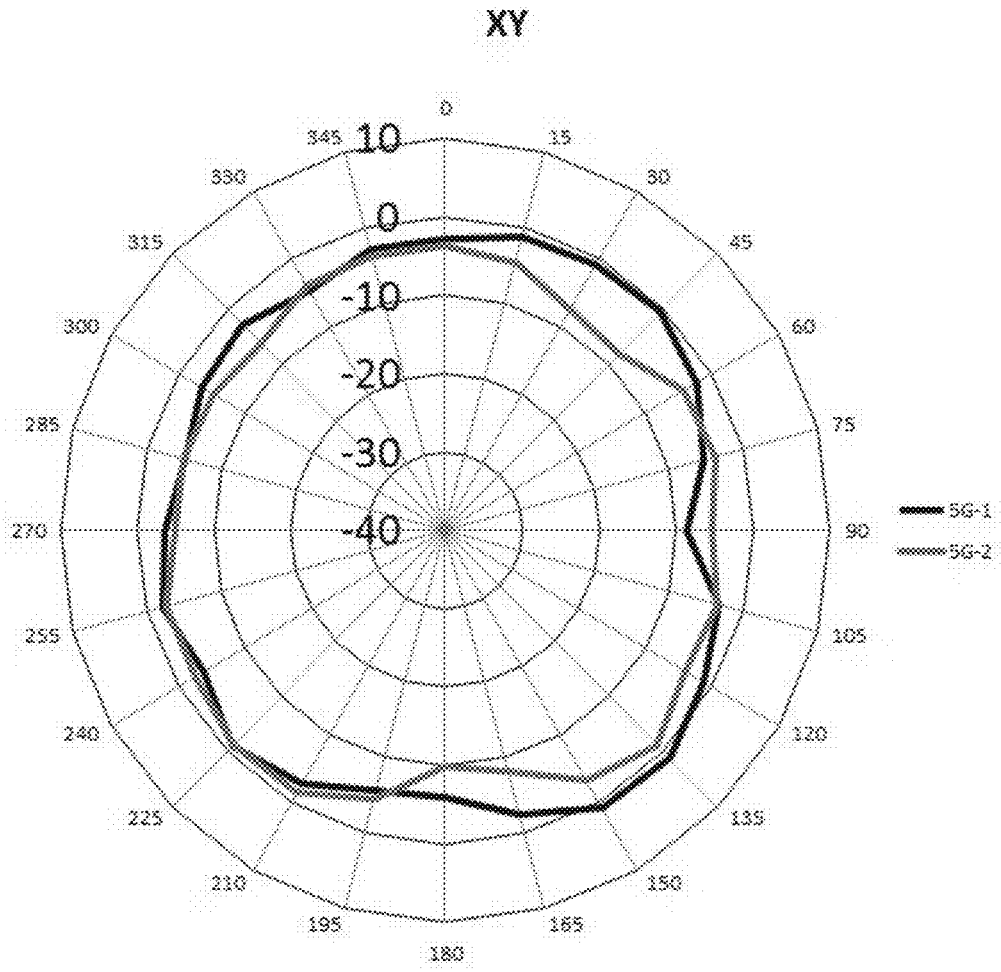
FIG. 9C shows X-Y plane radiation patterns of the high-frequency antenna unit in FIG. 7.
Figure 10A:
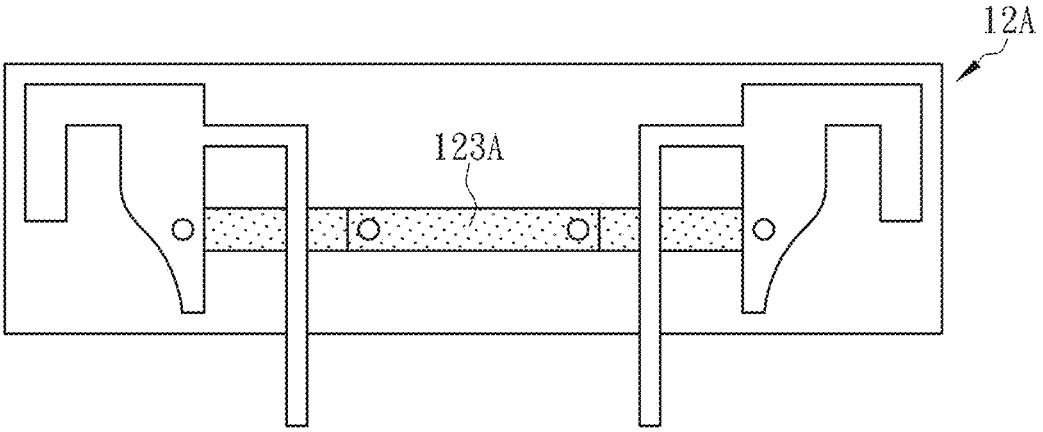
FIG. 10A schematically shows a high-frequency neutralization line of the present invention that has an assembled configuration.
Figure 10B:
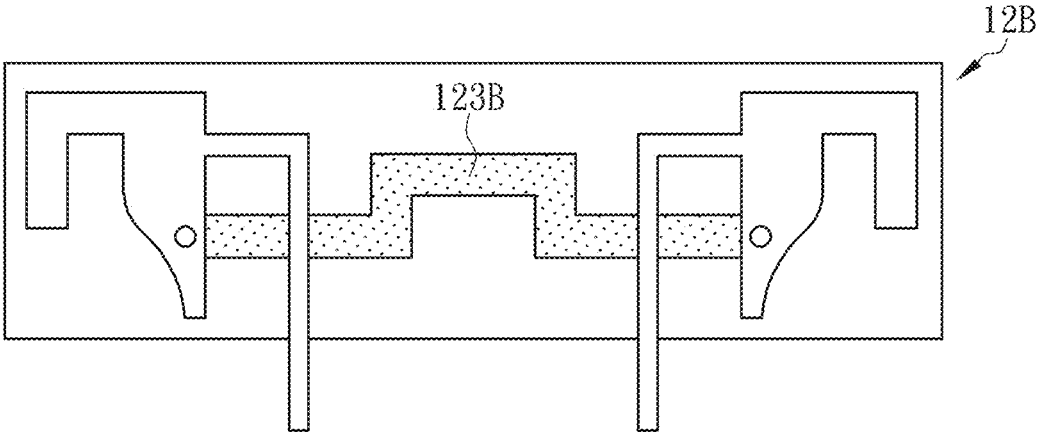
FIG. 10B schematically shows a high-frequency neutralization line of the present invention that has a winding configuration.
Figure 10C:
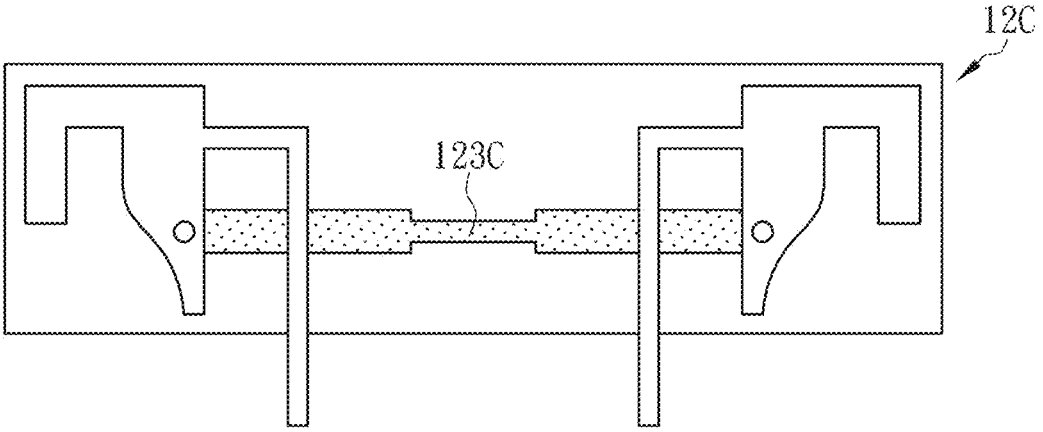
FIG. 10C schematically shows a high-frequency neutralization line of the present invention that has a step-shaped configuration.

The applicant tested the high-frequency antenna unit 12 shown in FIG. 2 and FIG. 7, and the test results are plotted in FIG. 8, in which it can be clearly seen that the high-frequency antennas 121 and 122 have an isolation of −31 dB when the high-frequency antenna unit 12 operates in the 5.33 GHz, and an isolation of −15 dB when the high-frequency antenna unit 12 operates in the 5 GHz band (5.15 GHz~5.85 GHz). In terms of radiation patterns, referring to FIG. 9A to FIG. 9C, the high-frequency antenna unit 12 produces omnidirectional in the Z-Y plane(see FIG. 9A), complementary in the X-Z plane (see FIG. 9B) and X-Y plane(see FIG. 9C), wherein the complementarity of radiation patterns is demonstrated, for example, by the fact that recesses of the X-Z plane radiation pattern of the first high-frequency antenna 121 are covered and compensated by the X-Z plane radiation pattern of the second high-frequency antenna 122. In other embodiments of the present invention, the high-frequency neutralization line 123 as well as the first and the second high-frequency antennas may be adjusted in configuration to meet product requirements, as shown by the high-frequency antenna units 12A~12C in FIG. 10A to FIG. 10C. Each of the high-frequency neutralization lines 123A~123C may have an "assembled configuration" (i.e., composed of a plurality of elements interconnected), a "winding configuration" (i.e., with a plurality of bends), or a "step-shaped configuration". When the "assembled configuration" (in which a plurality of elements are connected to one another) is applied to a circuit board of a multilayer plate structure, the elements may be located in/on different layers of the circuit board, provided that the elements are electrically connected. The "step-shaped configuration" is formed by providing the high-frequency neutralization line 123C with different widths, which in turn give rise to different phases respectively.

According to the above, referring back to FIG. 2, the two antennas i.e., the first low-frequency antenna 111 and the second low-frequency antenna 112) of the low-frequency antenna unit 11 are located along the same edge of the circuit board 10, while the two antennas (i.e., the first high-frequency antenna 121 and the second high-frequency antenna 122) of the high-frequency antenna unit 12 are located along another edge of the circuit board 10. Thus, not only can the layout traces from the two low-frequency antennas to the low-frequency module 13 and from the two high-frequency antennas to the high-frequency module 14 be effectively shortened, but also wire crossover (intersection) can be reduced. In a 4×4 MIMO antenna assembly, for example, there will be one low-frequency antenna unit and one high-frequency antenna unit at each of two adjacent edges of the circuit board, and yet wire crossover will reduce than in a conventional antenna assembly where decoupling structures are used, thereby effectively avoiding an increase in signal attenuation or in RF loss to ensure the transmission quality of the antennas. Besides, the low-frequency neutralization line 113 and the high-frequency neutralization line 123 are so designed that each of the low-frequency antenna unit 11 and the high-frequency antenna unit 12 produces complementary radiation patterns that help maintain radiation efficiency. It should be pointed out that the aforesaid variations in configuration of the low-frequency antennas are equally applicable to the high-frequency antennas, and that the aforesaid variations in configuration of the high-frequency neutralization line are equally applicable to the low-frequency neutralization line.

Figure 11:
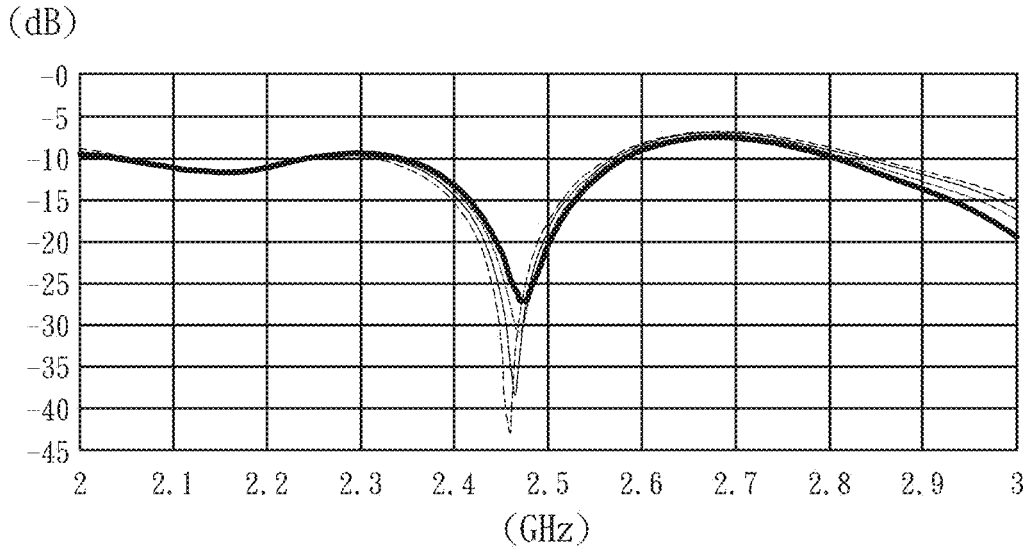
FIG. 11 is a plot showing test results of a low-frequency antenna unit of the present invention in relation to variation in width of the low-frequency neutralization line.
Figure 12:
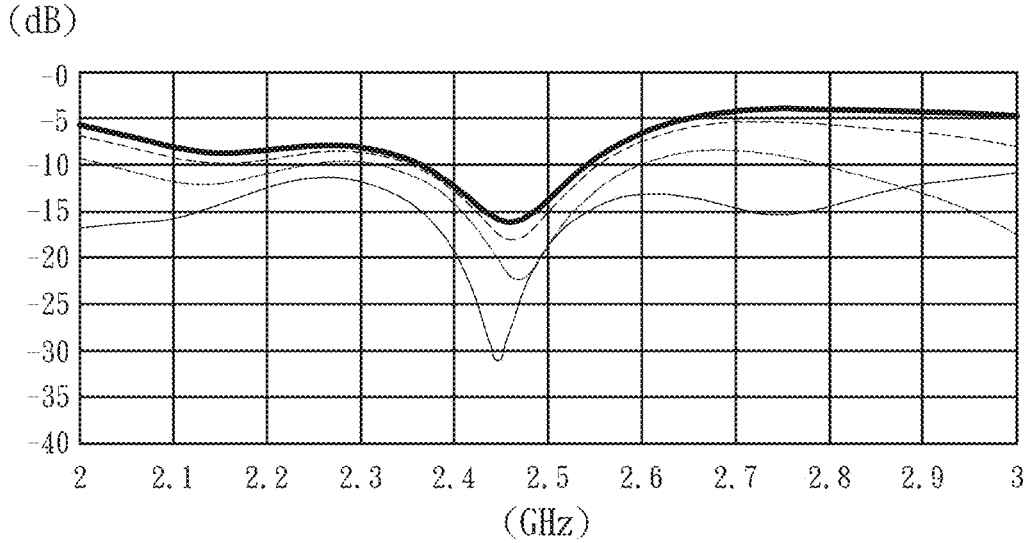
FIG. 12 is a plot showing test results of a low-frequency antenna unit of the present invention in relation to variation in the grounding distance of the low-frequency neutralization line.

Further, depending on product requirements, the configuration of the low-frequency neutralization line 113 may be adjusted to create the desired level of isolation in a specific working band. Referring back to FIG. 3, the low-frequency neutralization line 113 has a width W1 and is spaced from the grounding surface by a grounding distance G1. A reduce in the width W1 of the low-frequency neutralization line 113 with no change in the grounding distance G1 leads to the test results in FIG. 11 of the low-frequency antenna unit 11. It can be clearly seen in FIG. 11 that, when the width W1 of the low-frequency neutralization line 113 is changed sequentially from 4.7 mm to 4.2 mm, 3.7 mm, and 3.2 mm, the isolation valley varies accordingly (from −27 dB to −31 dB, −38 dB, and −43 dB, in that order), and the antennas' properties tend toward capacitors. In contrast, an increase in the grounding distance G1 with no change in the width W1 of the low-frequency neutralization line 113 leads to the test results in FIG. 12 of the low-frequency antenna unit 11. It can be clearly seen in FIG. 12 that, when the grounding distance G1 of the low-frequency neutralization line 113 is changed sequentially from 0.2 mm, 0.5 mm, 0.8 mm, and 1.1 mm, the isolation valley varies accordingly (from −15 dB to −18 dB, −24 dB, and −38 dB, in that order), and the antennas' properties tend toward inductors. The high-frequency antenna unit 12 shows the same properties as stated above.

Figure 13:
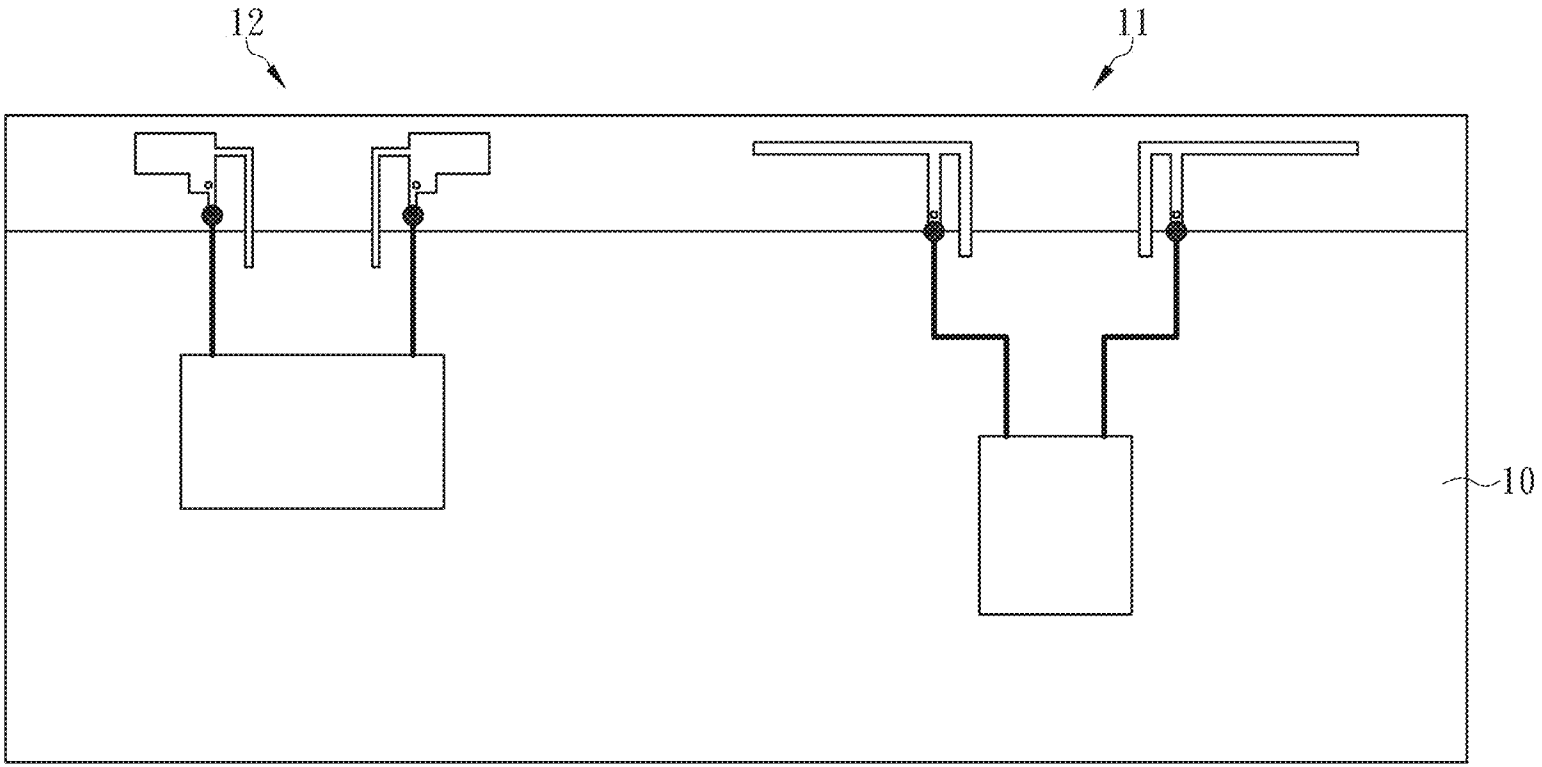
FIG. 13 schematically shows an embodiment of the present invention whose low-frequency antenna unit and high-frequency antenna unit are located along the same edge of a circuit board.
Figure 14:
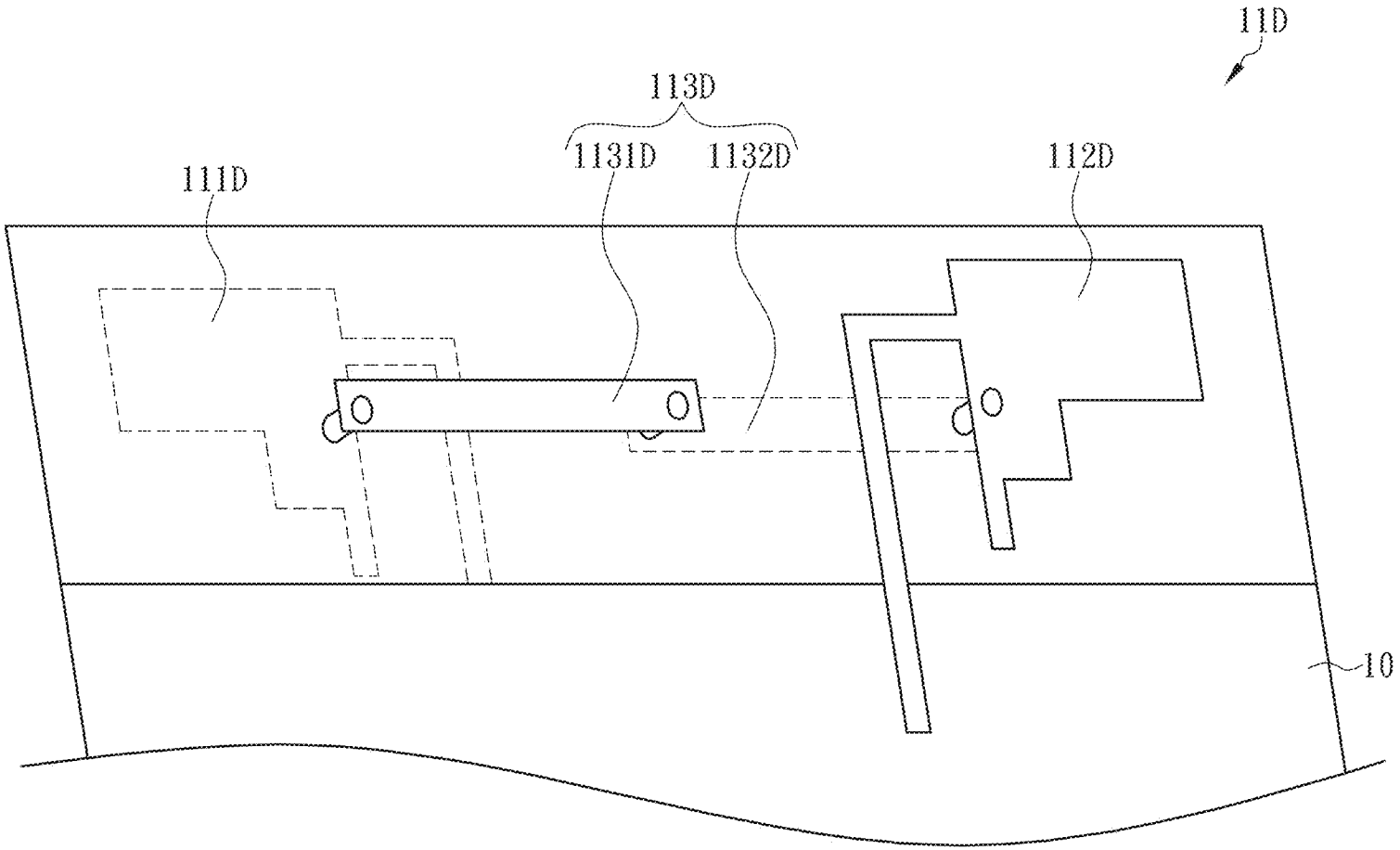
FIG. 14 schematically shows another embodiment of the low-frequency antenna unit of the present invention.

Apart from the foregoing configurations, the low-frequency antenna unit 11 and the high-frequency antenna unit 12 may be provided along the same edge of the circuit board 10 as depicted in FIG. 13, in which the neutralization lines are not shown because they are not in/on the same layer as the antennas. In another embodiment as shown in FIG. 14, the low-frequency antenna unit 11D includes a first low-frequency antenna 111D, a second low-frequency antenna 112D, a first neutralization line 1131D, and a second neutralization line 1132D. The first low-frequency antenna 111D and the first neutralization line 1131D are located in/on different layers of the circuit board 10 respectively (e.g., on the top and bottom sides respectively, or vice versa). One end of the first neutralization line 1131D is electrically connected to the first low-frequency antenna 111D. The first neutralization line 1131D and the second neutralization line 1132D are also located in/on different layers of the circuit board 10 respectively. The other end of the first neutralization line 1131D is electrically connected to one end of the second neutralization line 1132D such that a low-frequency neutralization line 113D (i.e., a neutralization line of an "assembled configuration") is formed. The other end of the second neutralization line 1132D is electrically connected to the second low-frequency antenna 112D. The high-frequency antenna unit, too, can use the structure described above.

It should be pointed out that the antenna assemblies in the foregoing embodiments have two wireless antenna units (i.e., the low-frequency antenna unit 11 and the high-frequency antenna unit 12) by way of example only. The antenna assembly of the present invention may vary in configuration, provided that the circuit board 10 includes an antenna module (equivalent to the low-frequency module 13 or the high-frequency module 14), that the circuit board has one edge provided with at least one wireless antenna unit (equivalent to the low-frequency antenna unit 11 or the high-frequency antenna unit 12), and that the wireless antenna unit is composed of a first antenna of the PIFA structure, a second antenna of the PIFA structure, and a neutralization line, and has the structural features disclosed in the above embodiments (i.e., the first antenna and the second antenna are spaced apart from each other, and the two ends of the neutralization line correspond to the first antenna and the second antenna respectively in an overlapping manner and are electrically connected to the first antenna and the second antenna respectively to shorten layout traces and reduce the space occupied on the circuit board 10).

While the invention herein disclosed has been described by means of specific embodiments, numerous modifications and variations could be made thereto by those skilled in the art without departing from the scope of the invention set forth in the claims.

What is claimed is:

1. An antenna assembly with compact layout traces, wherein the antenna assembly is applicable to a multi-input multi-output (MIMO) system-based product, the antenna assembly comprising:

a circuit board provided with a low-frequency module and a high-frequency module;

at least one low-frequency antenna unit located at an edge of the circuit board and electrically connected to the low-frequency module, wherein the low-frequency antenna unit is composed of a first low-frequency antenna of a planar inverted-F antenna (PIFA) structure, a second low-frequency antenna of the PIFA structure, and a low-frequency neutralization line; the first low-frequency antenna and the second low-frequency antenna are spaced apart from each other; the low-frequency neutralization line has two ends corresponding respectively to the first low-frequency antenna and the second low-frequency antenna in an overlapping manner; and the two ends of the low-frequency neutralization line are electrically connected to the first low-frequency antenna and the second low-frequency antenna respectively; and at least one high-frequency antenna unit located at another edge of the circuit board and electrically connected to the high-frequency module, wherein the high-frequency antenna unit is composed of a first high-frequency antenna of the PIFA structure, a second high-frequency antenna of the PIFA structure, and a high-frequency neutralization line; the first high-frequency antenna and the second high-frequency antenna are spaced apart from each other; the high-frequency neutralization line has two ends corresponding respectively to the first high-frequency antenna and the second high-frequency antenna in an overlapping manner; and the two ends of the high-frequency neutralization line are electrically connected to the first high-frequency antenna and the second high-frequency antenna respectively.

2. The antenna assembly of claim 1, wherein the low-frequency antenna unit operates at 2 GHz~2.5 GHz.

3. The antenna assembly of claim 2, wherein the high-frequency antenna unit operates at 5 GHz~5.85 GHz.

4. The antenna assembly of claim 1, wherein the low-frequency neutralization line is electrically connected to the first low-frequency antenna and the second low-frequency antenna separately.

5. The antenna assembly of claim 4, wherein the high-frequency neutralization line is electrically connected to the first high-frequency antenna and the second high-frequency antenna separately.

6. The antenna assembly of claim 5, wherein the first low-frequency antenna and the second low-frequency antenna are located in/on different layers of the circuit board.

7. The antenna assembly of claim 6, wherein the first high-frequency antenna and the second high-frequency antenna are located in/on different layers of the circuit board.

8. The antenna assembly of claim 7, wherein the low-frequency neutralization line or the high-frequency neutralization line is of an assembled configuration, a winding configuration, or a step-shaped configuration.

9. An antenna assembly with compact layout traces, wherein the antenna assembly is applicable to a multi-input multi-output (MIMO) system-based product, the antenna assembly comprising:

a circuit board provided with a low-frequency module and a high-frequency module;

at least one low-frequency antenna unit located at an edge of the circuit board and electrically connected to the low-frequency module, wherein the low-frequency antenna unit is composed of a first low-frequency antenna of a planar inverted-F antenna (PIFA) structure, a second low-frequency antenna of the PIFA structure, and a low-frequency neutralization line; the first low-frequency antenna and the second low-frequency antenna are spaced apart from each other; the low-frequency neutralization line has two ends corresponding respectively to the first low-frequency antenna and the second low-frequency antenna in an overlapping manner; and the two ends of the low-frequency neutralization line are electrically connected to the first low-frequency antenna and the second low-frequency antenna respectively; and at least one high-frequency antenna unit located at the same edge of the circuit board as the low-frequency antenna unit and electrically connected to the high-frequency module, wherein the high-frequency antenna unit is composed of a first high-frequency antenna of the PIFA structure, a second high-frequency antenna of the PIFA structure, and a high-frequency neutralization line; the first high-frequency antenna and the second high-frequency antenna are spaced apart from each other; the high-frequency neutralization line has two ends corresponding respectively to the first high-frequency antenna and the second high-frequency antenna in an overlapping manner; and the two ends of the high-frequency neutralization line are electrically connected to the first high-frequency antenna and the second high-frequency antenna respectively.

10. The antenna assembly of claim 9, wherein the low-frequency antenna unit operates at 2 GHz~2.5 GHz.

11. The antenna assembly of claim 10, wherein the high-frequency antenna unit operates at 5 GHz~5.85 GHz.

12. The antenna assembly of claim 9, wherein the low-frequency neutralization line is electrically connected to the first low-frequency antenna and the second low-frequency antenna separately.

13. The antenna assembly of claim 12, wherein the high-frequency neutralization line is electrically connected to the first high-frequency antenna and the second high-frequency antenna separately.

14. The antenna assembly of claim 13, wherein the first low-frequency antenna and the second low-frequency antenna are located in/on different layers of the circuit board.

15. The antenna assembly of claim 14, wherein the first high-frequency antenna and the second high-frequency antenna are located in/on different layers of the circuit board.

16. The antenna assembly of claim 15, wherein the low-frequency neutralization line or the high-frequency neutralization line is of an assembled configuration, a winding configuration, or a step-shaped configuration.

* * * * *